United States Patent [19]

Condon

[11] Patent Number: 4,640,155

[45] Date of Patent: Feb. 3, 1987

[54] HANDLE WITH ALTERNATE TOOL ORIENTATION

[76] Inventor: Harry F. Condon, 147 S. Howell St., Hillsdale, Mich. 49242

[21] Appl. No.: 813,090

[22] Filed: Dec. 24, 1985

[51] Int. Cl.[4] ..... B25B 23/00

[52] U.S. Cl. ..... 81/439; 81/177.5; 81/177.6; 81/177.8; 81/440

[58] Field of Search ..... 81/439, 440, 177.8, 81/177.5, 177.6

[56] References Cited

U.S. PATENT DOCUMENTS

| | | | |
|---|---|---|---|
| 1,578,065 | 3/1926 | Bemus et al. . | |
| 1,578,114 | 3/1926 | Fegley | 81/177.5 |
| 2,182,673 | 12/1939 | Magnano | 145/61 |
| 2,569,069 | 9/1951 | Motel | 145/50 |
| 2,821,403 | 1/1958 | Bevan | 279/14 |
| 3,850,056 | 11/1974 | Allen | 81/71 |
| 4,056,020 | 11/1977 | Coviello | 81/177 A |

*Primary Examiner*—Frederick R. Schmidt
*Assistant Examiner*—Joseph T. Zatarga
*Attorney, Agent, or Firm*—Beaman & Beaman

[57] ABSTRACT

A hand tool for transmitting torque having a handle wherein a tool implement may be mounted in alternative positions on the handle. The handle includes a slot intersecting an end and the tool implement, such as an Allen wrench or a screwdriver, includes a head molded thereon having a configuration closely conforming to the handle slot. A projection formed on the head transverse to the length of the implement cooperates with bores defined in the handle during the alternative mountings of the implement from the slot. In its operative positions the length of the implement is disposed parallel to the handle axis or transversely thereto.

8 Claims, 8 Drawing Figures

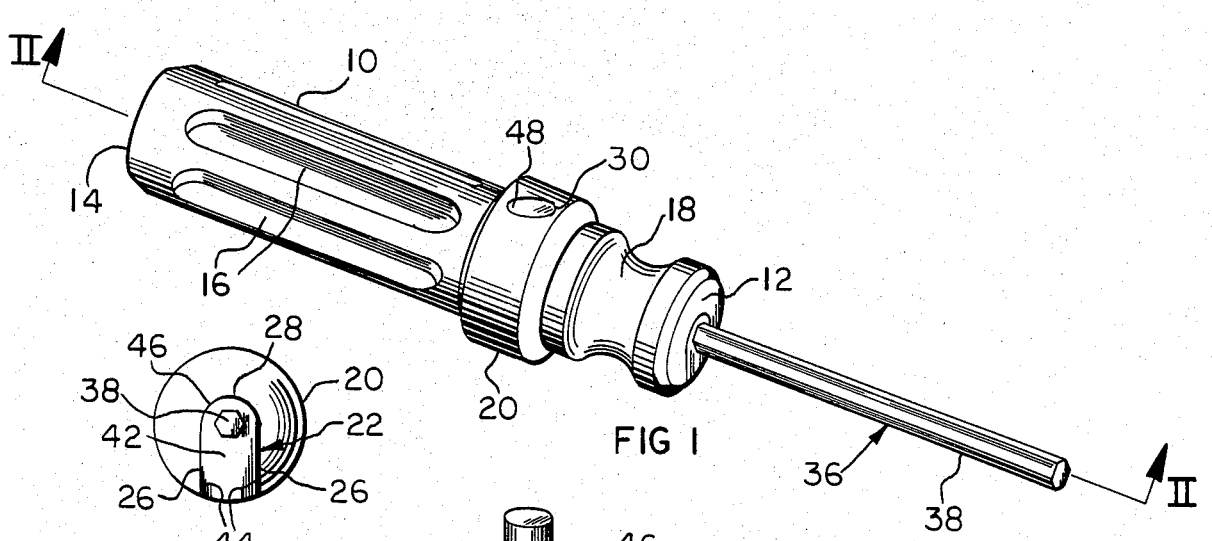
FIG 1
FIG 4
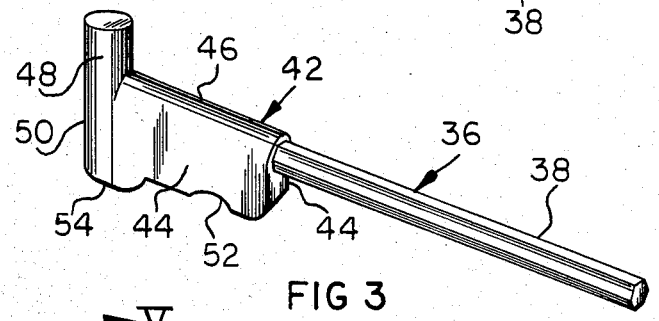
FIG 3
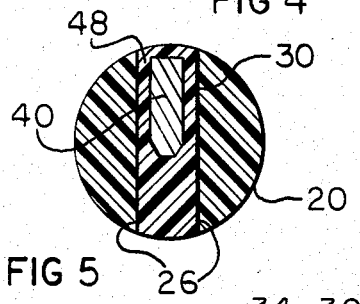
FIG 5
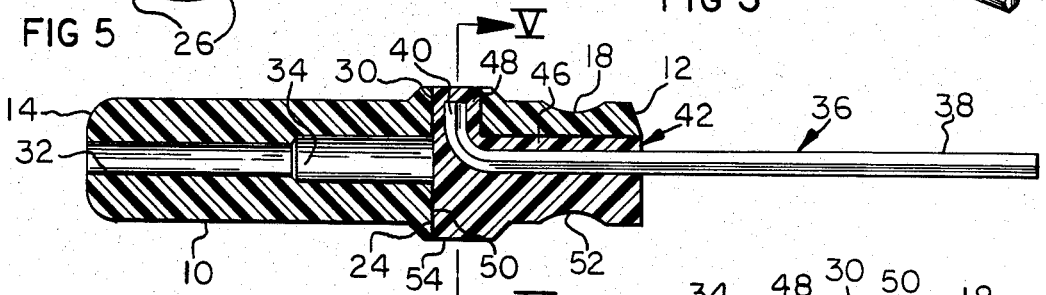
FIG 2
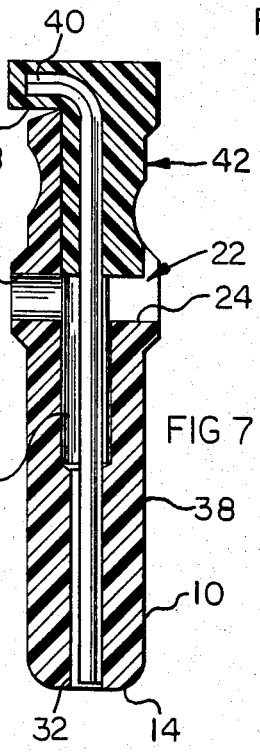
FIG 7
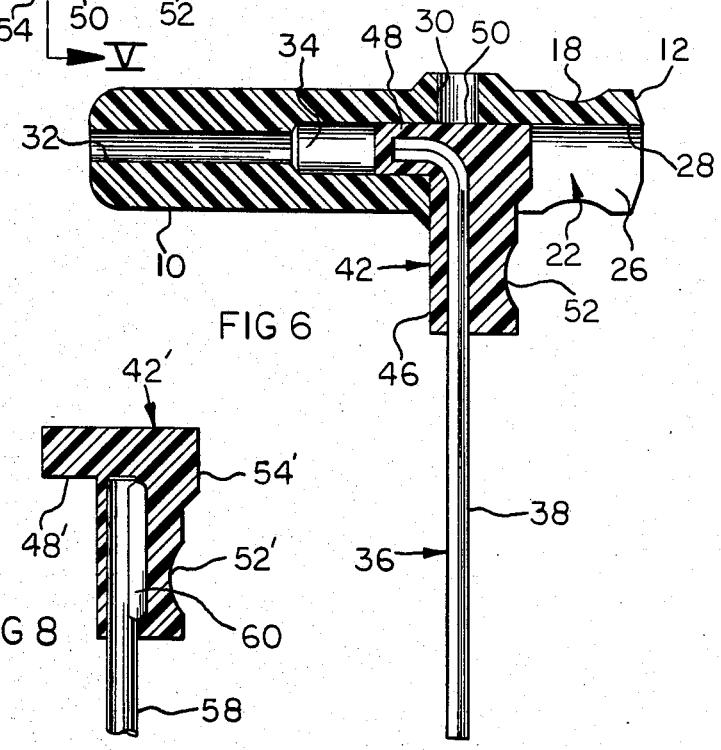
FIG 6
FIG 8

HANDLE WITH ALTERNATE TOOL ORIENTATION

BACKGROUND OF THE INVENTION

For increased versatility, and economy of manufacture, it is known to provide hand tools having a handle with a blade or implement, or a plurality of blades or implements, wherein a plurality of different sizes of implements may be selectively used with a single handle, or the implement may be selectively mounted upon the handle in different orientations thereto for improving dexterity, ease of use or increasing torque.

Examples of hand tools wherein the implements may be selectively mounted on a handle in alternative positions are shown in U.S. Pat. Nos. 1,578,065; 2,182,673; 2,569,069; 2,821,403; 3,850,056 and 4,056,020.

While the prior art tools having handles wherein implements may be alternately mounted thereon may provide improved versatility of use, those tools presently available are relatively expensive and often difficult to use and assemble.

It is an object of the invention to provide a hand tool having a handle wherein a torque transferring implement may be alternatively mounted upon the handle in two operative positions wherein one position provides optimum ease of use and rapidity of tool rotation, while the other position permits maximum torque to be manually applied to the tool.

A further object of the invention is to provide a hand tool having a handle in which a radial slot is defined intersecting a handle end, the slot closely selectively receiving a head formed on an elongated implement in a variety of positions wherein the implement may be selectively oriented to the handle to improve ease of use and rapidity of rotation or maximum torque, or the implement may be stored within the tool handle.

An additional object of the invention is to provide a hand tool having a molded handle in which a radial slot formed therein intersects a handle end and an implement formed with a molded head is closely receivable within the slot in torque transfer relationship thereto in alternate positions to improve the versatility of the tool.

Yet an additional object of the invention is to provide a hand tool having a handle having a radial slot formed therein intersecting the handle end wherein a head formed upon a tool implement may be selectively mounted in the slot in torque transmitting relationship thereto, and the implement head includes a projection selectively cooperating with bores formed in the handle to prevent removal of the implement from the slot in a direction parallel to the implement length.

In the practice of the invention a tool handle, usually formed of a synthetic plastic material by a molding operation, includes a longitudinal axis and front and rear ends. A radial slot intersects the handle and handle front end and includes parallel spaced sides radially offset with respect to the handle axis.

The elongated metal implement, such as an Allen wrench or a screwdriver blade, includes an inner end having a synthetic plastic head molded thereon which is of a configuration to permit the head to be closely received within the handle slot in a torque transfer relationship therewith. The head includes parallel side surfaces spaced apart a distance substantially corresponding to the spacing of the slot sides, and the transverse cross-sectional configuration of the slot and the head, in the preferred embodiment, is of a U-configuration wherein the slot sides tangentially intersect the concave base surface and the head sides tangentially intersect a convex base cylindrical surface.

A head is provided with a cylindrical projection at the inner terminal end of the head which is of a diameter corresponding to the transverse thickness of the head and has an axis perpendicularly disposed to the length of the implement. The handle includes a pair of cylindrical bores having axes at right angles to each other, both bores intersecting the handle slot and selectively closely receiving the implement head projection wherein the implement and head may not be pulled from the handle slot in the axial direction of the implement due to the cooperation of the head projection and a handle bore.

The configuration of the handle slot, and the location of the bores, is such that the implement head, and implement, may be assembled to the handle in one of two operative positions, i.e. with the length of the implement coaxial with the handle axis, or disposed substantially perpendicular thereto. When the implement length is coaxial with the handle axis, the ease of use of tool operation is greatest, as is the ability to rotate the handle and implement with the least effort and greatest speed. When the implement head is located in the slot such that the length of the implement is perpendicular of the handle axis, maximum torque may be applied to the handle and implement.

The handle is also provided with an elongated axial bore which intersects the slot and extends through the handle to its rear end. This bore is of sufficient diameter to receive the implement, and it is possible to insert the implement head into the slot wherein the major portion of the implement length will be received within the handle bore and the implement is thereby located in a storage position with respect to the handle.

BRIEF DESCRIPTION OF THE DRAWINGS

The aforementioned objects and advantages of the invention will be appreciated from the following description and accompanying drawings wherein:

FIG. 1 is a perspective view of a hand tool in accord with the invention, the implement being assembled to the handle in a coaxial manner, FIG. 2 is a diametrical, elevational, sectional view of the assembled tool as taken along section II—II of FIG. 1, FIG. 3 is a perspective view of the implement, per se, FIG. 4 is an end view of FIG. 1 as taken from the right end thereof, FIG. 5 is an elevational, sectional view as taken through Section V—V of FIG. 2, FIG. 6 is a diametrical, elevational, sectional view of the assembled tool with the implement length perpendicularly disposed to the handle length for producing maximum torque, FIG. 7 is a diametrical, elevational, sectional view illustrating the storage position of the implement with respect to the handle, and FIG. 8 is a detail, partial, sectional view of another embodiment of implement head as molded to the implement in torque transfer relationship thereto.

DESCRIPTION OF THE PREFERRED EMBODIMENT

The tool includes a handle 10, preferably molded of synthetic plastic, and the handle includes a front end 12 and a rear end 14. Exteriorly, the handle includes longitudinally disposed recesses 16 for increasing the frictional grip of the operator on the handle, and adjacent its front end 12, the handle exterior surface includes a recess 18 and a circumferentially extending ridge 20. The handle is formed with a radial slot 22 therein, the slot intersecting the front end 12 and extending into the length of the handle a distance represented by the surface 24, FIG. 2.

The slot 22 is of a U-shaped configuration including parallel sides 26 located upon each side of the handle axis and tangentially intersecting the slot cylindrical concave surface 28. A radial cylindrical recess or bore 30 is formed in the handle intersecting the ridge 20, and the slot surface 24 forms a portion of the bore 30 as the surface 24 comprises a semi-cylindrical segment defined by the bore.

The handle 10 is axially bored at 32 wherein bore 32 intersects the handle rear end 14 and an enlarged cylindrical recess or bore 34 coaxial with bore 32 intersects slot 22 and is of a diameter corresponding to that of bore 30.

The tool implement, generally represented at 36, is of an elongated configuration, and in the illustrated embodiment comprises an Allen wrench having a major length portion 38, and an inner end portion 40 disposed at right angles to the portion 38. It is to be understood that the disclosed Allen wrench implement 36 is only one type of implement that may be used with the invention. For instance, the tool may be used with any type of torque transmitting member wherein the implement may comprise a screwdriver blade, or may have wrench sockets affixed to the implement outer end, or other known torque transmitting tool members associated therewith.

The inner end of the implement 36 is provided with a head 42 preferably formed of a synthetic plastic material and molded upon the implement inner end in an integral manner as to be in a torque transmitting relationship thereto. The head 42 includes opposed planar sides 44 which are parallel to each other and spaced apart a distance corresponding to the spacing between the slot sides 26. The head sides 44 intersect the cylindrical convex surface 46 which is of a diameter corresponding to the cylindrical concave diameter surface 28 of the slot. The head includes the cylindrical projection 48 which, in the embodiment of FIGS. 1–7, surrounds the Allen wrench portion 40 and has a diameter only slightly less than the diameter of the bores 30 and 34. The configuration of the projection 48 merges into the rest of the head configuration in that the diameter of the projection is equal to the spacing between the head sides 44 and the innermost end 50 of the head is defined by the semi-cylindrical extension of the projection.

The head 42 is also formed with an outer side surface configuration including a recess 52 and a ridge 54 which correspond to the shape of the handle recess 18 and ridge 20.

In the usual operative condition the head 42 will be radially inserted into the slot 22 in the manner shown in FIGS. 1, 2, 4 and 5. By radially inserting the head 42 into the slot the projection 48 is received within the bore 30 and the head sides 44 are firmly located between the slot sides 26. Upon engagement of the head convex surface 46 with the slot concave surface 28, the length of the implement portion 38 will be coaxial with the handle axis and the implement 36 will be located in the handle 10 in its position most suitable for handling and rapid rotation. In this position, as represented in FIGS. 1 and 2, it will be appreciated that the head recess 52 and ridge 54 align with and conform to the handle recess 18 and ridge 20 and a unitary and attractive appearance is achieved.

As the projection 48 is received within the bore 30 the implement 36 may not be pulled from the slot 22 in an axial direction. However, when it is desired to remove the implement from the slot, radial movement of the head 42 relative to the handle 10 to withdraw the head from the slot and the projection 48 from the bore 30 permits the handle 10 and implement 36 to be separated. This removal of the head from the slot can be facilitated by the operator depressing the outer end of the projection 48 with the thumb or a finger in that the projection outer end is exteriorly accessible at the bore 30 as will be appreciated from FIGS. 1 and 2.

When it is desired that the greatest torque be produced by the implement 36 the implement and head 42 are inserted into the slot 22 in the manner shown in FIG. 6. In this relationship the inner end of the head is inserted into the slot, while the length of the implement portion 38 is perpendicularly related to the handle axis. Upon the head 42 being fully received into the slot, such that the cylindrical convex projection surface 50 engages the slot base surface 28, the implement and head are moved axially toward the bore 34 wherein the projection 48 is firmly received within the bore 34, FIG. 6. With the components assembled as shown in FIG. 6, maximum torque can be applied to the implement due to the greater torque arm producible by the orientation of the handle to the implement, and the tool may be readily used. In the mode of assembly shown in FIG. 6, the reception of the projection 48 in the bore 34 prevents removal of the implement and head from the slot 22 in the axial direction of the implement portion 38.

When the head 42 is received within the slot 22 in either manner as shown in FIGS. 2 or 6, the engagement of the slot sides 26 with the head sides 44, and the reception of the head projection 48 in either bore 30 or bore 34 produces a positive torque transfer relationship between the implement 36 and the handle 10, and high torque forces can be transferred between the handle and implement without damage to the components.

It is also possible to assemble the implement 36 and head 42 to the handle 10 in a storage position as shown in FIG. 7 wherein the length of the tool is minimized and a concise configuration achieved. As shown in FIG. 7, the implement portion 38 is received within the handle bore 32, and the head 42 will be received with the slot 22 in a manner reverse to that shown in FIG. 2. As the head 42 is firmly received within the slot in this relationship, the assembly of FIG. 7 will be maintained.

It will be appreciated that the shape and dimensions of the slot 22 and the head 42 are such that in either position of FIG. 2 or FIG. 6 that the head conforms to the slot at engaging surfaces. For instance, slot surface 24 is semi-cylindrical to closely receive head surfaces 50 or 46, FIG. 2, and slot semi-cylindrical surface 28 conforms to head surface 46, FIG. 2, or surface 50, FIG. 6. The diameter of projection 48 equals the width of head 42 as defined by sides 44 and surface 50 is an extension of the projection configuration.

FIG. 8 illustrates a modification of attachment of the implement to the head. In this figure the implement 58 is of a cylindrical form, such as would be used with a screwdriver shank, and the inner end of the implement is provided with a radially extending key 60 which may be swaged from the implement material and radially extends beyond the cylindrical configuration thereof. The synthetic plastic head 42' is molded upon the inner end of the implement 58 and is of a configuration identical to the head 42 previously described wherein identical components are indicated by prime reference numerals. The presence of the key 60 assures an effective connection of the implement 58 with respect to the head 42' and an effective torque transmitting interconnection between the implement and head is provided.

It will be appreciated that the invention is directed to a tool of economical construction wherein a plurality of different sizes or types of torque transmitting implements may be used with a single handle. Of course, any type of size Allen wrench, socket, or screwdriver blade may be associated with the outer end of the implement, and each size of implement will, of course, utilize a head 42 which cooperates with the handle slot 22 in the described manner. By alternately mounting the implement in the handle slot so that the length of the implement is either coaxial or transverse to the handle axis the desired convenience and torque producing characteristics can be achieved, and a tool construction in accord with the invention may be economically produced and requires no special skills on the part of the operator.

It is appreciated that various modifications to the inventive concepts may be apparent to those skilled in the art without departing from the spirit and scope of the invention.

I claim:

1. A hand tool having a tool implement alternately positionable upon a handle comprising, in combination, an elongated handle having an outer surface, an axis, a front end and a rear end, an elongated axially extending radial slot defined in said handle laterally intersecting said handle outer surface and said handle front end, said slot including spaced, opposed flat parallel sides defined upon opposite sides of said handle axis and radially spaced relative thereto, an elongated implement having an axis, an outer end and an inner end, torque drive means defined on said implement outer end, a head integrally fixed on said implement inner end, said head including a pair of spaced parallel sides spaced apart a distance substantially equal to the spacing of said slot's sides whereby said head may be firmly received within said slot in a first position wherein said implement axis is substantially parallel to said handle axis and extends from said handle front end and a second position wherein said implement axis is transversely disposed to said handle axis, an elongated projection defined on said head extending in a direction transverse to said implement axis, a first recess defined in said handle and intersecting said slot having a length transversely disposed to said handle axis, a second recess defined in said handle and intersecting said slot having a length substantially parallel to said handle axis, said head projection being closely received within said first recess when said head is in said first position and closely received within said second recess when said head is in said second position, reception of said projection within a recess preventing withdrawal of said head from said slot in a direction parallel to said implement axis.

2. In a hand tool as in claim 1, said head projection being of a cylindrical configuration, said first and second recesses comprising cylindrical bores.

3. In a hand tool as in claim 1, said first recess intersecting the exterior of said handle whereby said head projection is exteriorly accessible when received within said first recess.

4. In a hand tool as in claim 1, said second recess being coaxial with said handle axis.

5. In a hand tool as in claim 1, said implement being formed of metal, said head being formed of synthetic plastic and being molded upon said implement inner end.

6. In a hand tool as in claim 5, said head having an outer surface conforming in configuration with the configuration of said handle outer surface whereby when said head is in said first position within said slot said head outer surface aligns with and conforms to the adjacent handle outer surface.

7. In a hand tool as in claim 5, a bore defined in said handle intersecting said slot and extending toward said handle rear end, said bore receiving said implement outer end in an implement storage position when said head is located within said slot in a third position wherein said implement extends toward said handle rear end.

8. In a hand tool as in claim 5, said slot being of a U transverse cross section wherein said slot sides define the legs of said U cross section, said head having a transverse U cross section corresponding to that of said slot, said head projection being of a cylindrical configuration having a diameter equal to the slot width and defining the innermost end of said head whereby said projection conforms to and engages the U base of said slot when said head is in said second position within said handle slot.

* * * * *